US005617946A

United States Patent [19]

Acampora et al.

[11] Patent Number: 5,617,946

[45] Date of Patent: Apr. 8, 1997

[54] PUSH-BUTTON SWITCH

[75] Inventors: Vincent P. Acampora, Bristol; William J. Vumback, North Ford, both of Conn.

[73] Assignee: C & K Components, Inc., Watertown, Mass.

[21] Appl. No.: 399,948

[22] Filed: Mar. 6, 1995

Related U.S. Application Data

[63] Continuation of Ser. No. 246,577, May 20, 1994, abandoned, which is a continuation of Ser. No. 60,496, May 11, 1993, abandoned, which is a continuation of Ser. No. 894,540, Mar. 11, 1992, abandoned.

[51] Int. Cl.[6] ..... H01H 5/20

[52] U.S. Cl. ..... 200/407; 200/249

[58] Field of Search ..... 200/407, 460, 200/461, 459, 286, 249

[56] References Cited

U.S. PATENT DOCUMENTS 3,576,416 4/1971 Good ..... 200/249 X
4,032,734 6/1977 Burch ..... 200/407
4,424,506 1/1984 Burch ..... 200/407
5,017,747 5/1991 Nagahara et al. ..... 200/453

*Primary Examiner*—Renee S. Luebke
*Attorney, Agent, or Firm*—Pearson & Pearson

[57] ABSTRACT

A push-button switch includes a base, a cover and a button subassembly. The button subassembly attaches to the underside of and extends through an opening of the cover. The cover includes tabs that extend from each side with a locking element further extending from an inner surface of each tab that engages slots in the base to hold the base and cover together. The switch can include different length fixed contacts and rivets in place of contact pads. The contacts can include the fixed contacts extending in parallel horizontal planes and the same or spaced transverse planes. The switch can also employ a pivot arm and an adjustable member to control the gap between the fixed contacts and moveable contacts.

11 Claims, 6 Drawing Sheets

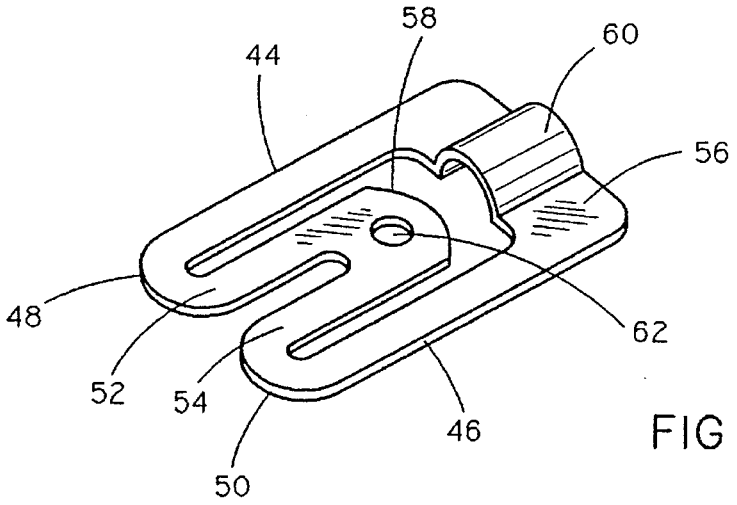
FIG. 2
FIG. 3
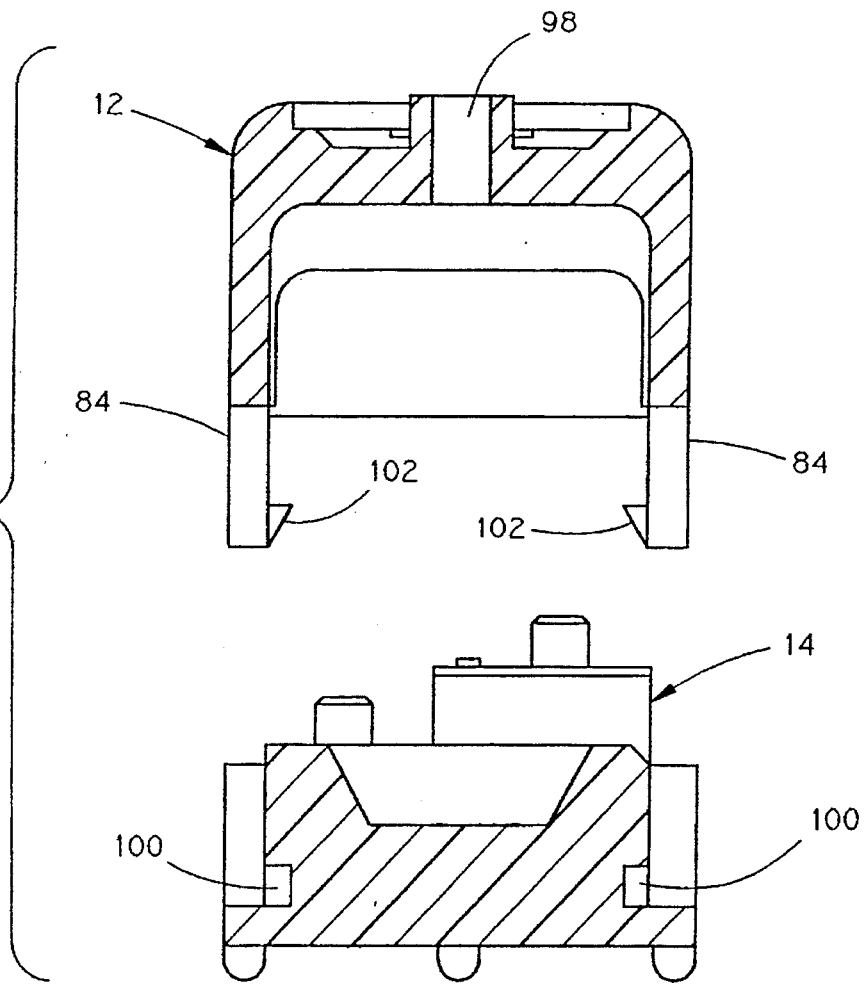

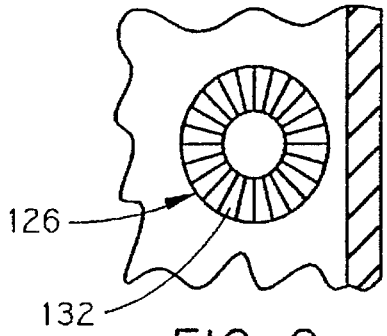
FIG. 8
FIG. 7
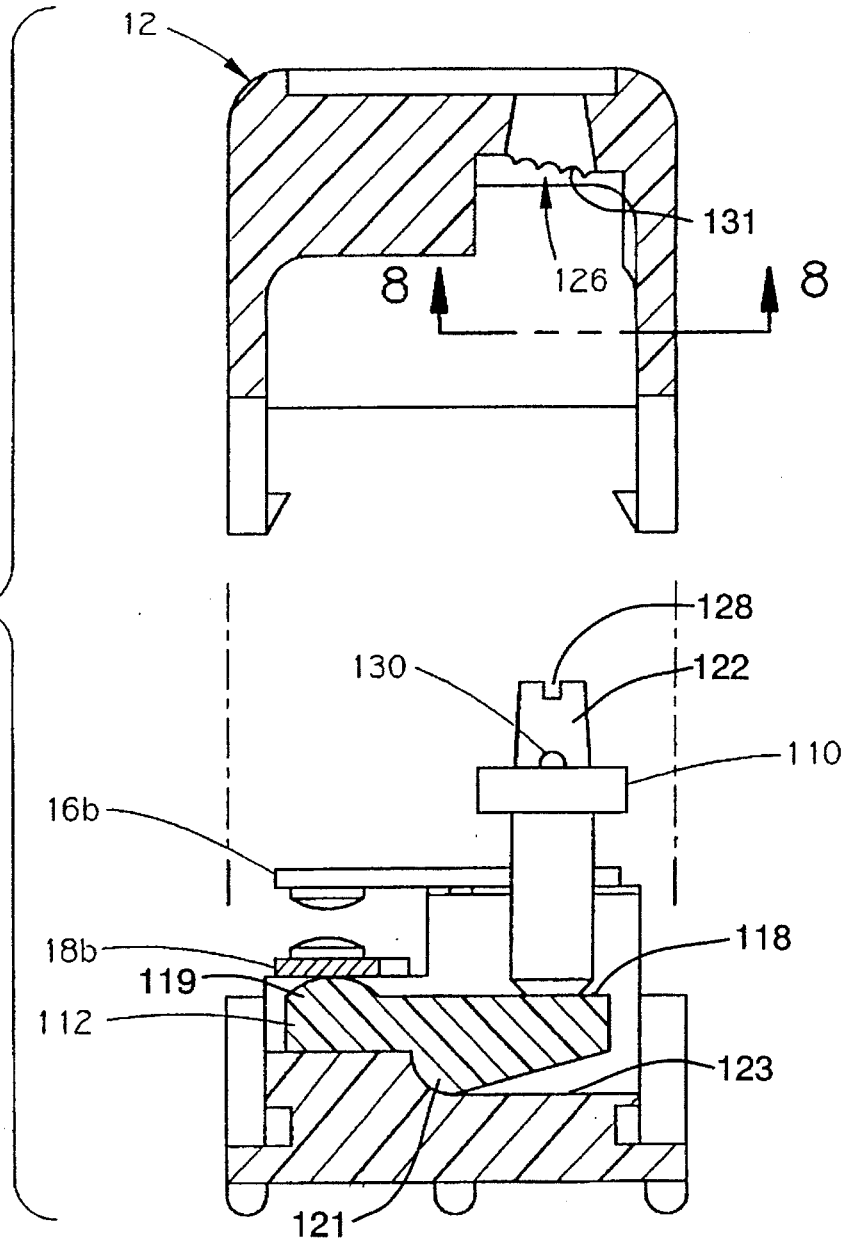

PUSH-BUTTON SWITCH

This is a continuation of my U.S. patent application Ser. No. 08/246577, filed May 20, 1994, which was a continuation of U.S. patent application Ser. No, 08/060496, filed May 11, 1993, which was a continuation of U.S. patent application Ser. No. 07/894540, filed Mar. 11, 1992, all now abandoned.

BACKGROUND OF THE INVENTION

This invention relates to electrical switches and in particular to a push button switch having a biased subassembly with an actuator for adjusting the bias, a camming means for adjusting the space between electrical contacts of the switch and a removable cover with an aperture for adjusting the space between the contacts.

SUMMARY OF THE INVENTION

This is a push-button switch having a cover with a top having an underside and a through opening. The push-button switch includes a button subassembly attached to the underside and engaging the through opening. The cover also has tabs extending from each side which have a locking element extending from the inner surface of each tab which engages a slot formed on each side of the base of the push-button switch to hold the cover and the base together. A variation of the push-button switch has a pivot arm and an adjustable member. These two elements are used to adjust the gap between the fixed and movable contacts.

BRIEF DESCRIPTION OF THE DRAWINGS

Further details are explained below with the help of the example(s) illustrated in the attached drawings in which:

FIG. 2 is a perspective of the over-center blade movable contact of the push-button switch shown in FIG. 1;

FIG. 3 is a sectional exploded view of the push-button switch shown in FIG. 1;

FIG. 7 is a sectional exploded view of the push-button switch shown in FIG. 6; and FIG. 8 is a bottom plan view, broken off, of an adjustable member and through opening of a molded plastic cover of the push-button switch shown in FIG. 6.

DESCRIPTION OF THE PREFERRED EMBODIMENT(S)

Figure 1:
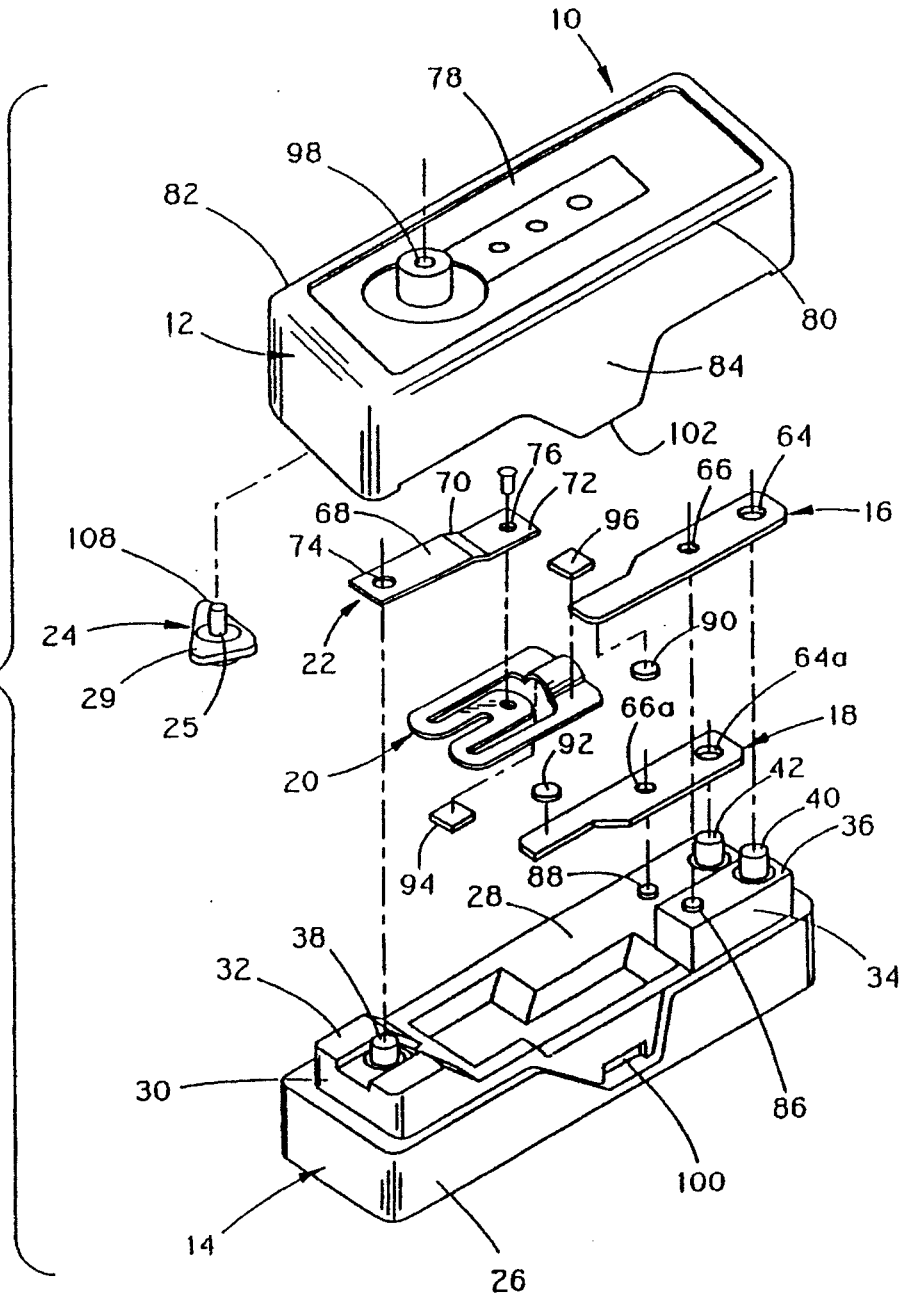
FIG. 1 is an exploded perspective view of the push-button switch according to the present invention.

There is shown in the drawings a push-button switch 10 including a molded plastic cover 12, 1 molded plastic base 14, a normally open fixed contact 16, a normally closed fixed contact 18, an over-center blade movable contact 20, a beam element 22 and a button subassembly 24.

The base 14 comprises a base portion 26 generally rectangular in configuration having an upper surface 28. At one end of the upper surface 28, a rectangular first land 30 is integrally formed having a first surface 32. At the other end of the upper surface 28 from that of the first land 30 is an integral second land 34 having a second surface 36. The surface 32 and the second surface 36 are positioned on a horizontal plane in spaced parallel relation with the upper surface 28 of the base portion 26. A stud like insert 38 extends integrally upward from a shallow channel formed centrally on the first land 30. A stud like first contact engagement insert 40 extends integrally upward from the second surface 36 of the second land 34. A stud like second contact engagement insert 42 extends integrally upward from the upper surface 28 of the base portion 26 in close proximity to the second land 34.

With reference to FIG. 2, the over-center blade movable contact 20 comprises an outer first leg portion 44 and an outer second leg portion 46. The outer first leg portion 44 has a first end which is integral with an arced first connector portion 48 and the outer second leg portion 46 has a first end which is integral with an arced second connector portion 50. The arced first connector portion 48 is connected to a primary end of a first inner leg 52 and the arced second connector portion 50 is connected to a primary end of a second inner leg 54. Second ends of the outer first and second leg portions 44, 46 remote from the first ends are joined together by an integral bridging portion 56. The ends of the first and second inner legs 52, 54 remote from their connection with the first and second connector portions 48, 50 are joined together by an integral web 58. An arcuate raised portion 60 is formed centrally in the bridging portion 56 and a through aperture 62 is formed centrally in the web 58.

Referring now to FIG. 1, the normally open fixed contact 16 includes a flat rectangular body portion having one end narrower than the remaining portion of the fixed contact 16. A first through opening 64 is positioned on the longitudinal midline in close proximity to the wider end of the fixed contact 16. A second through opening 66 is formed on the longitudinal midline spaced from the first opening and positioned between the narrow end and the first opening 64 of the fixed contact 16.

The normally closed fixed contact 18 is a mirror image of the fixed contact 16. A first through opening **64*a* is positioned on the longitudinal midline in close proximity to the wider end of the fixed contact 18. A second through opening 66*a* is formed on the longitudinal midline spaced form the first opening and positioned between the narrow end and the first opening 64*a* of the fixed contact 16**.

The beam element is generally rectangular in configuration and includes a first section 68 having a free terminal end. A connector section 70, which extends integrally from the other end of the first section 68 at an angle, connects integrally with the end of a second section 72. The first and second sections 68, 72 lie on spaced parallel planes. A through first hole 74 is formed in the first section 68 and a second through hole 76 is formed in the second section 72.

The cover 12 has a top 78 having a first long edge, a second long edge, a first short edge and a second short edge. A first long side 80 extends integrally from the first long edge and a second long side 82 extends integrally from the second long edge in spaced parallel relation to the first long side 80. Each of the first and second long sides 80, 82 include an integral tab 84 which extends from the center of the lower edge thereof. Short sides connect the first and second long sides 80, 82 to complete the box like configuration of the cover 12.

Assembly of the push button switch 10 may be accomplished by passing the first contact engagement insert 40 through the first opening 64 of the normally open fixed contact 16 and the first stud 86, which extends integrally upward from the second surface 36 of the second land 34 forward of the first contact engagement insert 40, through the second opening 66 of the contact 16. The second contact engagement insert 42 is padded through the first opening 64*a*, and a second stud 88, which extends integrally upward from the upper surface 28 of the base 14 forward of the second contact engagement insert 42, is passed through the second opening 66*a* of the normally close contact 18. The inserts 40, 42 are upset to complete assembly of the fixed contacts 16, 18 to the base 14. A first contact element 90 is attached to the under surface of the narrow end of the normally open contact 16. A second contact element 92 is attached to the upper surface of the narrow end of the normally closed contact 18. A rivet is passed through the second hole 76 of the beam 22 and then through the aperture 62 of the over-center blade 20. Upsetting the rivet forms a subassembly. The subassembly of the beam 22 and over-center blade 20 is put together with the base portion 26 by passing the insert 38 through first hole 74 of the beam 22. The insert 38 is upset to complete this aspect of the assembly. The under surface of the bridging portion 56 (FIG. 2) adjacent the outer first leg portion 44 has a silver first contact part 94 attached thereto and the upper surface of the bridging portion 56 (FIG. 2) adjacent the outer second leg portion 46 has a second silver contact part 96 attached thereto. The over-center blade 20 of the attached subassembly is positioned with the base 14 with the first silver contact part 94 in abutting relation with the second silver contact part 96.

A through opening 98 is formed through the top 78 of the cover 12. The button subassembly, which includes an actuator 25 and a base portion 29 is assembled with the underside of the top 78 of the cover 12 by passing the actuator 25 through the opening 98. The actuator 25 movably extends through the opening 98 when the switch 10 is assembled. The base portion 29 also bears against the beam element 22 holding the button subassembly 24 in place. Each of the tabs 84 include on their inside surface a locking element 100. The assembly of the cover 12 and the button subassembly 24 are aligned with the base assembly and each of the locking elements 100 of the tabs 84 engages in ones of slots 102 formed on both sides of the base 14.

The switch 10 is designed to be mounted by means of screws or studs utilizing mounting holes (not shown) on one of the long sides of the base 14. In a normal rest position the subassembly of the beam element 22 and over-center blade 20 make contact with the normally closed fixed contact 18 allowing current to flow through the circuit. In the normal rest position the normally open circuit has a gap between the beam element 22 and over-center blade 20 subassembly and the normally open fixed contact 16 that interrupts the path of the current flow. As the upper surface 108 of the button subassembly 24 is depressed to a nominal dimension of 0.625 inch from the mounting holes the beam element 22 deflects along with the longitudinal axis of the over-center blade 20 to a cross-over point at which the circuit changes state making contact with the normally open fixed contact 16, allowing current to flow through the circuit. In the depressed state, the normally closed circuit has a gap between the beam element 22/over-center blade 20 subassembly and the normally closed fixed contact 18 interrupting the path of the current flow. When the upper surface 108 of the button 24 is completely released, the switch 10 changes state back to its rest or normally closed position.

Figure 4:
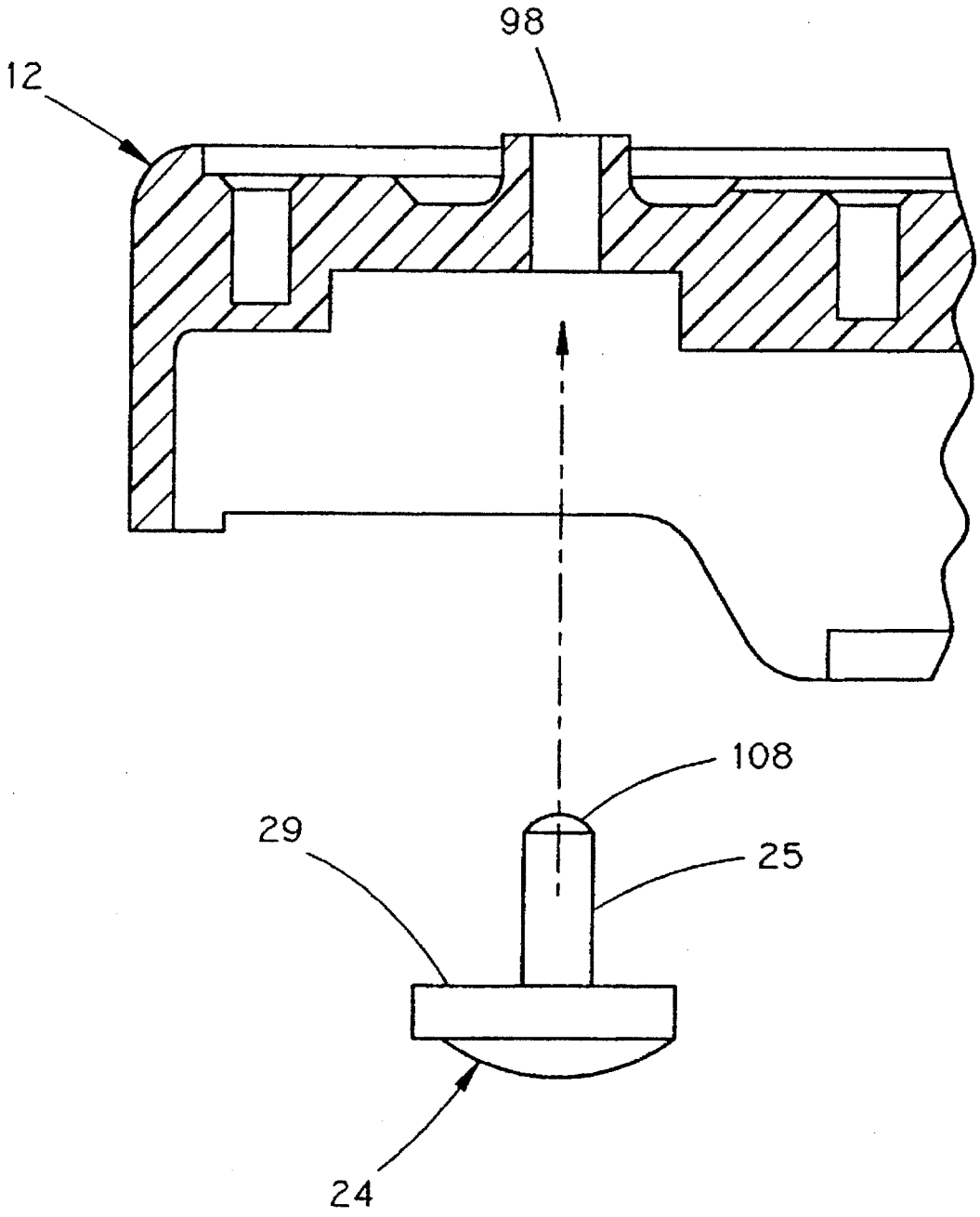
FIG. 4 is a section, broken off, and partly in elevation of the cover and button subassembly of the push-button switch shown in FIG. 1.
Figure 5:
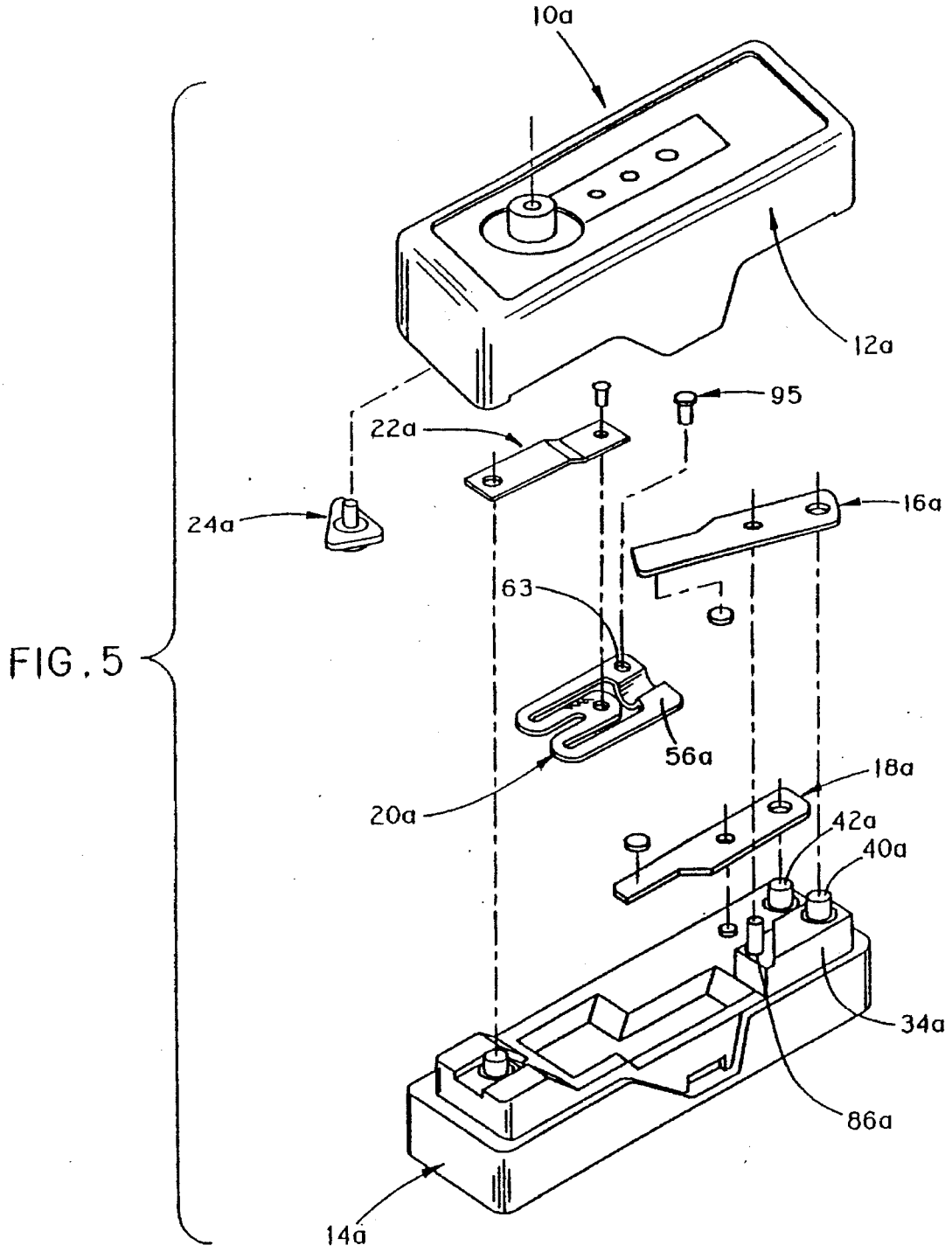
FIG. 5 is an exploded view of a variation of the push-button switch shown in FIG. 1.

A variation of the switch 10 is shown in FIG. 5 as the push-button switch 10*a*. The push-button switch 10*a* includes a molded plastic cover 12*a*, a molded plastic base 14*a*, a normally open fixed contact 16*a*, a normally closed fixed contact 18*a*, an over-center movable blade 20*a*, a beam element 22*a* and a button subassembly 24*a*. In the switch 10 of FIG. 1 the normally open fixed contact 16 and the normally closed fixed contact 18 are of equal dimensions. However, in the variation 10*a* of FIG. 5, the normally open fixed contact 16*a* is longer than the normally closed fixed contact 18*a*. The first and second contact engagement inserts 40*a*, 42*a* are positioned in the variation the same as in the original however the first stud 86*a* is positioned closer to the inner wall of the second land 34*a* angling the position of the normally open contact 16*a* relative to the position of the contact 16 of FIG. 1. The first stud 86*a* lies on a horizontal plane below the plane on which the first contact engagement 40*a* lies. Additionally, the first stud 86*a* extends upwardly above the plane on which the first contact engagement 40*a* lies (for Example 86*a* of FIG. 5). Both the contacts 16*a*, 18*a* are positioned on the molded plastic base 14*a* similarly to the normally open fixed contact 16 and the normally closed fixed contact 18 of FIG. 1, respectively. The first and second contact pads 94, 96 of FIG. 1 have been removed from the variation of FIG. 5. A second aperture 63 is formed through the bridging portion 56*a* of the switch 10*a* as shown in FIG. 5. A solid silver rivet 95 is passed through the second aperture 63 and riveted in place. A coined silver wire contact 97 is attached to the normally open contact 16*a* and a coined silver wire contact 99 is attached to the normally closed contact 18*a* as shown in FIG. 4. Operation and assembly of the switch 10*a* is the same as the operation of the switch 10 of FIG. 1 as are all elements the switch 10 which have not been specifically mentioned in this paragraph.

Figure 6:
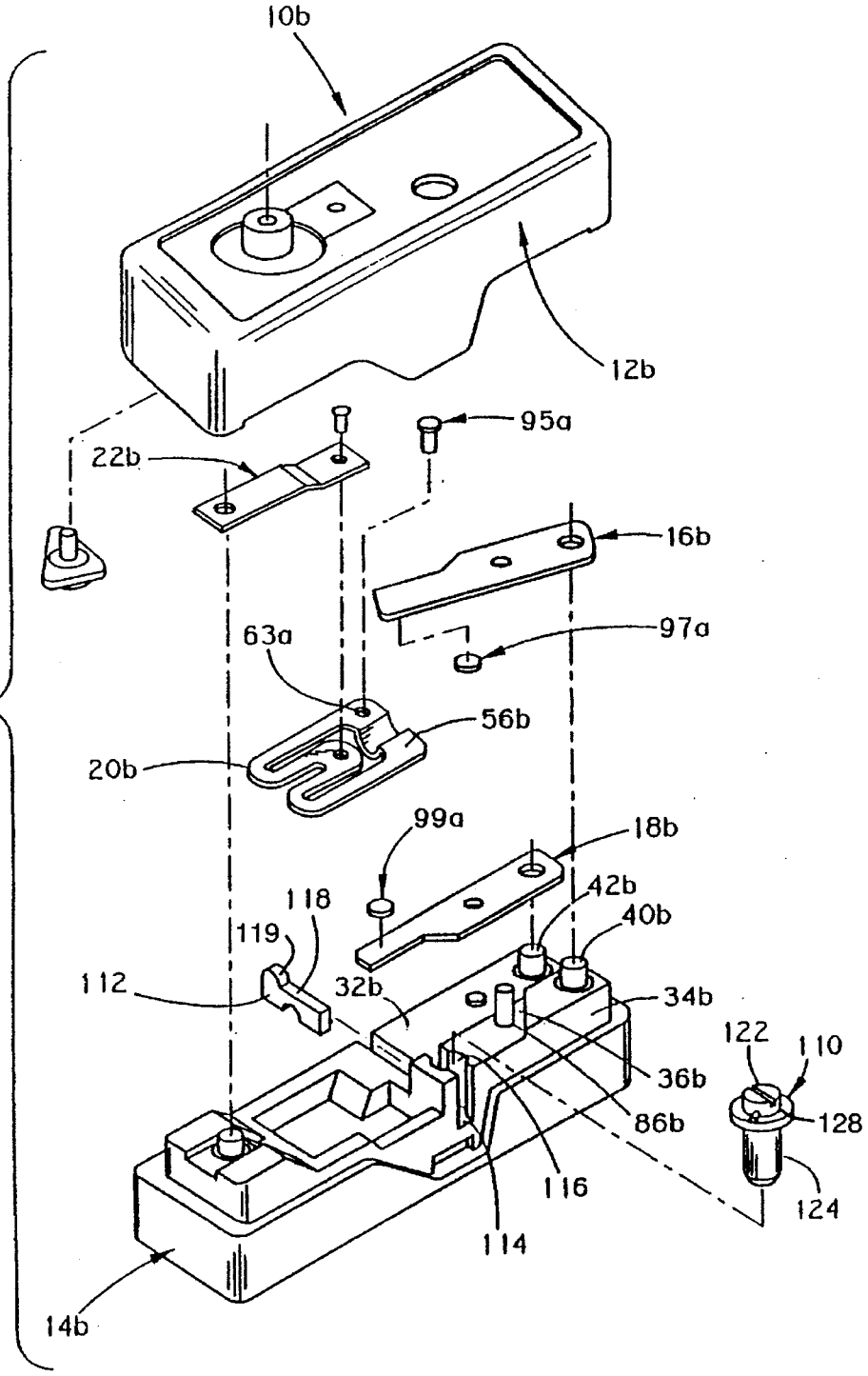
FIG. 6 is an exploded view of a second variation of the push-button switch shown in FIG. 1.

The second variation of the switch 10 is shown in FIGS. 6–8 as the push-button switch 10*b*. The push-button switch 10*b* includes a molded plastic cover 12*b*, a molded plastic base 14*b*, a normally open fixed contact 16*b*, a normally closed fixed contact 18*b*, an over-center movable blade 20*b*, a beam element 22*b* and a button subassembly 24*b*. In the switch 10 of FIG. 1 the normally open fixed contact 16 and the normally closed fixed contact 18 are of equal dimensions however, in the variation 10*b*, the normally open fixed contact 16*b* is longer than the normally closed fixed contact 18*b*. The first and second contact engagement inserts 40*b*, 42*b* are positioned in the variation 10*b* as in the original switch 10, however the first stud 86*b* is positioned closer to the inner wall of the second land 34*b* angling the position of the normally open contact 16*b* relative to the position of the contact 16 of FIG. 1. The first stud 86*b* lies on a horizonal plane below the plane on which the first contact engagement 40*b* lies. Additionally, the first stud 86*b* extends upwardly above the plane or with the first contact engagement 40*b* lies as best illustrated in FIG. 6. The first and second contact pads 94, 96 of FIG. 1 have been removed from the variation of FIGS. 6 through 8. A second aperture 63*a* is formed through the bridging portion 56*b* of the switch 10*b* as shown in FIG. 6. A solid silver rivet 95*a* is passed through the second aperture 63 and riveted in place. A coined silver wire contact 97*a* is attached to the normally open contact 16*b* and a coined silver wire contact 99*a* is attached to the normally closed contact 18*b* as shown in FIG. 6. Variation 10*b* includes two additional components which are not found in the switch 10 or its first variation 10*a* and construction changes in the first and second lands 30*b*, 34*b* and the cover 12*b* which are not found in the switch 10 or its first variation 10*a*. The added components are an adjustable member 100 and a pivot arm 112. A slot 114 is formed through the surface 28*b* and the second surface 36*b* as shown in FIG. 6. A part of the slot 114 formed in the second surface 36*b* provides a locating hole 116. The pivot arm 112 comprises a generally rectangular support portion 118. The pivot arm 112 is mounted in the slot 114 somewhat as a rocker arm before the normally closed contact 18*b* is positioned on the second contact engagement insert 42*b*. The pivot arm 112 has an upper surface which at an end includes a protuberance 119 that is located under the normally closed contact 18*b*. A convexity 121 is spaced from the protuberance and is positioned on the other side of the support portion 118. Between the convexity 121 and an end of the pivot arm 112 opposite the end including the protuberance 119, the lower surface of the pivot arm angles upwardly as shown in FIG. 7. The lower surface of the slot 114 includes a plateau whose inner wall is arced and merges into a flat surface 123 as shown in FIG. 7. The end of the pivot arm 112 including the protuberance 119 abuts the plateau of the slot 114 and the arced portion holds the convexity 121. The flat surface 123 of the lower surface of the slot 114 provides a stop for the movement of the pivot arm when the adjustable member 110 is utilized. The adjustable member 110 comprises a head portion 122 and a shaft 124. The shaft 124 extends from the center of the head portion 122 and upon assembly extends in the locating hole 116 prior to the assembly of the cover/button subassembly with the base 14*b*. The head portion 122 includes a slot 128 and a protuberance 130. The cover 12*b* includes an adjustable member through opening 126 as shown in FIG. 6. In the final assembly, the head portion 122 of the adjustable member 110 is passed partially through the adjustable member through opening 126. The present design permits adjustment of the contact gap of the switch 10*b*. A screw driver (not shown) can be inserted in the slot 128 and turned clockwise, a protuberance 130 of the head portion 122 rides along a series of descending radial grooves or detents inside the opening 126 pulling the adjustable member 110 downward causing the pivot arm 112 to tilt with the end including the protuberance 119 to move upward moving the end of the normally closed contact 18*b* closer to the normally open contact 16*b* closing the gap of the switch 10*b*. That is, the adjustable member 110 is a cam follower, and the camming surface includes a series of detents 131 extended along a spiral path. The detents 131 inhibit unintended movement of the adjustable member 110. At a minimum gap the angled surface of the pivot arm 112 will bear against the flat surface of the lower surface of the slot 114 which acts as a stop. The adjustable member 110 can also be turned counter-clockwise thereby opening the gap. Operation and assembly of the switch 10*b* is otherwise the same as the operation of the switch 10*a* as are all elements of the switch 10*a* which have not been specifically mentioned in this paragraph.

What we claim is:

1. An improved push-button switch having a base supporting normally open and closed contacts, a biased subassembly including an over-center blade contact and a beam support that supports the blade contact for movement between a biased position and an actuated position, the blade contact having a first portion of a first surface contacting the normally closed contact in the biased position and a second portion of a second opposed surface for selectively contacting the normally open contact in the actuated position, a cover and a push-button with an actuator extending through an aperture in the cover and a base portion engaging the biased subassembly such that upon urging the actuator downward relative to the cover the first portion is urged away from the normally closed contact and the second portion is urged into contact with the normally open contact, wherein the improvement comprises first means in said base for supporting the normally open contact in a first horizontal plane along a first axis and a second means in said base for supporting the normally closed contact in a second parallel horizontal plane in a second axis horizontally displaced from the first axis such that the portions of said blade contact that contact the normally open and closed contacts in the actuated and biased positions, respectively, are horizontally spaced from each other; and said base includes first and second proximate and horizontally, parallel planar surfaces, the open and closed contacts are similarly shaped with each having first and second corresponding apertures therein, and said first and second supporting means includes contact engagement inserts with one of said contact engagement inserts extending from each of said first and second planar surfaces of the base, said contact engagement inserts being spaced a given transverse distance and sized for being received in ones of the first corresponding apertures of said contacts and first and second studs sized for being received in ones of the second corresponding apertures, one of said studs extending from each of the first and second planar surfaces of the base spaced from the contact stud along the axis of the associated one of the normally open and closed contacts and spaced the given transverse distance from the other of said studs.

2. A push-button switch comprising;

A. a base;

B. first and second electrical contacts supported by said base in a spaced relationship;

C. a biased subassembly supported normally in a first position in electrical contact with said first electrical contact;

D. actuator means for actuating said biased subassembly into a second position out of electrical contact with said first electrical contact and into electrical contact with said second electrical contact;

E. camming means for selectively adjusting the spacing between said first and second contacts, said camming means includes a cam follower supported in said base; and F. a cover removably secured to said base having a first aperture in said cover enabling a user to access said camming means to adjust the spacing between the contacts.

3. A push-button switch as recited in claim 2 wherein said means for actuating extends through a second aperture in said cover.

4. A push-button switch as recited in claim 3 wherein said camming means further includes a pivot member pivotally supported by said base, said pivot member engaging at one end said second contact and am another end said cam follower, and a camming surface engaged by said cam follower such that actuation of said cam follower urges movement of said pivot member and thereby said second contact.

5. A push-button switch as recited in claim 4 wherein said cam follower includes a radially extending protuberance and said camming surface is a detented spiral surface in said cover along which said radial protuberance travels.

6. A push-button switch as recited in claim 2 wherein said camming means includes a camming surface in said cover, said cam follower engaging said camming surface, and a pivot member pivotally supported by said base with a first end engaging one of said first and second contacts and a second end engaging said cam follower such that moving said cam follower along said camming surface pivots said pivot member to urge displacement of one of said first and second contacts to adjust thereby the spacing between said first and second contacts.

7. A push-button switch comprising;

A. a cover with first and second apertures therein,

B. a base member supporting said cover, said base member including first, second and third lands with said first and second lands lying adjacent one another in parallel horizontal planes and said third land being longitudinally spaced from said first and second lands, C. first, second and third electrical contact engagement inserts mounted in each of said first, second and third lands, respectively, D. a normally closed contact supported on said first land in electrical contact with said first contact engagement insert, E. a normally open contact supported on said second land in electrical contact with said second contact engagement insert, F. an over-center blade and beam element subassembly supported by said third land in electrical contact with said third contact engagement insert and in biased contact with said normally closed contact, G. a push-button subassembly including an actuator extending through said first aperture and a base contacting said subassembly such that actuation of said actuator urges said over-center blade and beam element subassembly away from said normally closed contact and into contact with said normally open contact, and H. camming means for changing the spacing between portions of said normally closed contact and said normally open contact proximate said over-center blade and beam element subassembly, said camming means further includes user adjustment means accessible through said second aperture.

8. A push-button switch as recited in claim 7 wherein said user adjustment means includes a screw-like head.

9. A push-button switch as recited in claim 7 wherein said camming means includes a cam follower, a lever pivotally supported in said base having a first end engaging said cam follower and a second end engaging one of said normally closed and normally open contacts proximate said subassembly.

10. A push-button switch as recited in claim 9 wherein said camming means further includes a camming surface in said cover and said cam follower includes a portion spaced from said lever engaging said camming surface such that actuation of said cam follower urges displacement of said lever to urge thereby displacement of said one of said normally closed contact and said normally open contacts proximate said subassembly.

11. A push-button switch as recited in claim 10 wherein said camming surface includes a descending path with detents disposed therein and said portion of said cam follower is a radially extending portion sized for being received between said detents.

* * * * *